US009605936B1

(12) United States Patent
Burgan

(10) Patent No.: US 9,605,936 B1
(45) Date of Patent: Mar. 28, 2017

(54) WAD SPLAYING TOOL AND METHOD

(71) Applicant: Grover W. Burgan, Jacksonville, FL (US)

(72) Inventor: Grover W. Burgan, Jacksonville, FL (US)

( * ) Notice: Subject to any disclaimer, the term of this patent is extended or adjusted under 35 U.S.C. 154(b) by 0 days.

(21) Appl. No.: 15/231,855

(22) Filed: Aug. 9, 2016

(51) Int. Cl.
*F42B 33/00* (2006.01)
*F42B 7/08* (2006.01)

(52) U.S. Cl.
CPC ..... *F42B 33/001* (2013.01); *F42B 7/08* (2013.01)

(58) Field of Classification Search
CPC ..... F42B 33/004; F42B 33/02; F42B 33/10; F42B 7/08
USPC ..... 86/23, 24, 25, 29, 30
See application file for complete search history.

(56) References Cited

U.S. PATENT DOCUMENTS 2,061,576 A * 11/1936 Huyett ..... F42B 7/08 493/102
2,819,644 A * 1/1958 Corcoran ..... F42B 33/02 86/23
2,960,903 A * 11/1960 Scott ..... F42B 7/08 86/23
3,009,387 A * 11/1961 Puth ..... F42B 33/0292 86/29
3,057,247 A * 10/1962 Behrens ..... F42B 33/004 86/25
3,060,788 A * 10/1962 Blesi ..... F42B 33/004 86/27
3,105,408 A * 10/1963 Bachhuber ..... F42B 33/004 86/25
3,242,790 A * 3/1966 Bachhuber ..... F42B 33/004 86/25
3,323,405 A * 6/1967 Thorp ..... F42B 33/004 86/23
3,343,444 A * 9/1967 Lee ..... F42B 33/02 86/24
3,401,588 A * 9/1968 Olson ..... F42B 7/04 102/452
3,450,000 A * 6/1969 Ponsness ..... F42B 33/10 86/25
3,771,411 A * 11/1973 Hazel ..... F42B 33/004 86/24
3,796,127 A * 3/1974 Deitemeyer ..... F42B 33/004 86/25
4,078,472 A * 3/1978 Simpson ..... F42B 33/10 86/23
8,850,984 B2 * 10/2014 Smylie ..... A62D 3/02 102/301
2004/0025677 A1 * 2/2004 Koch ..... F42B 33/10 86/24
2004/0025678 A1 * 2/2004 Shields ..... F42B 33/02 86/31
2009/0090235 A1 * 4/2009 Brunn ..... F42B 7/12 86/18

* cited by examiner

*Primary Examiner* — Michael David
(74) *Attorney, Agent, or Firm* — Mark Young, P.A.

(57) ABSTRACT

Fingers of a wad are splayed, prior to loading the wad into a shotgun shell, by sliding the wad on a wad splaying tool. The tool has mandrel with a free end, a shank, a frusto-conical transition extending from the free end to the shank, and a supported end. The diameter of the free end is less than the diameter of the wad. The transition's diameter at the shank (i.e., where the transition meets the shank) exceeds the diameter of the wad.

15 Claims, 9 Drawing Sheets

WAD SPLAYING TOOL AND METHOD

FIELD OF THE INVENTION

This invention relates generally to shotgun shell reloading, and, more particularly, to a tool and method of splaying fingers of a wad during reloading.

BACKGROUND

During reloading of shotgun shells, a properly sized wad is placed into a shell. A wad is part of a shell between the powder and the shot. The wad provides a tight seal which permits expanding gas from the burning powder to push the shot column out of the barrel with maximum velocity. Modern wads (aka "wad columns") combine a shot cup and seal into one integrally formed plastic structure. Modern wads are available with specific heights and diameters to fit into specific size shells.

To seat a wad, it is pressed firmly into the base of the hull. When seated with a reloading tool or machine, a ram presses the wad into an aligned hull that has already been re-sized, de-primed, re-primed and loaded with the correct amount of powder. A wad must be seated correctly on top of the powder, with the top of the fingers of the wad below the crimp line of the shell. A cup formed by fingers of the properly seated wad then receives a correct amount of shot, i.e., generally spherical pellets of a determined diameter dense metal (e.g., typically lead). Then the top edge of the shell is crimped, typically through a multi-step process to achieve a desired closure configuration.

A modern wad consists of three parts, the powder wad, the cushion, and the shot cup, which may be separate pieces or be one part. The powder wad is the base of the wad that acts as a gas seal, and is placed firmly over the powder. The cushion is the interface between the powder wad and shot cup. The cushion may compress under pressure, to act as a shock absorber and minimize deformation of the shot. The cushion may also act as a spacer, taking up as much space as is needed between the powder wad and the shot. The shot cup, which is the last part of the shell, holds the shot together as it moves down the barrel. Shot cups have slits on the sides to form bendable fingers or petals ("fingers"). The fingers peel open after leaving the barrel, allowing the shot to continue on in flight undisturbed.

Wads are typically sold in large volumes (100s or 1000s) in a box or bag. During handling and storage, many of the fingers of wads are bent, often urged together. Even a slight bending can precipitate a reloading problem.

When a wad is pressed into a shell by a ram of a reloading machine, a side of the ram may snag fingers of the wad, particularly if the fingers are bent inwardly, even just slightly. The inward bending may be so slight as to be unnoticed by an operator. Such snagging is particularly commonplace and problematic with narrow diameter wads (e.g., wads for 0.410 bore shells). When a ram snags a wad finger, the ram may bend over and crush the finger in the shot cup. Such deformation not only prevents shot from filling the shot cup, but also may prevent proper seating and severely compromise flight of the shot.

To reduce the risk of snagging, heretofore, meticulous individuals have inserted a finger into a shot cup and rotated their finger in the shot cup before inserting the wad into a wad guide of a reloading machine. While somewhat effective for reducing risk of snagging, such a procedure is time consuming and eventually leads to finger sores, especially during a session of reloading hundreds of shells. Also, a finger is an asymmetrical and imprecise tool and does not produce a desired splaying of the wad fingers. Thus, when a finger is removed, a previously inwardly bent finger may return towards an inwardly bent position.

What is needed is a tool and methodology for splaying (i.e., bending outwardly) fingers of a wad before the wad is inserted into a wad guide for seating. A ram will not snag splayed fingers during insertion. Splayed fingers will bend into the form of a shot cup upon insertion.

The invention is directed to overcoming one or more of the problems and solving one or more of the needs as set forth above.

SUMMARY OF THE INVENTION

To solve one or more of the problems set forth above, in an exemplary implementation of the invention, a method of splaying fingers of a wad prior to loading the wad into a shell (shotgun shell) and a tool for splaying fingers of a wad prior to loading the wad into a shell are provided. A wad is a generally cylindrical plastic sleeve having a diameter, a first end, a second end, and a bottom covering at the second end. The first end is open. A plurality of parallel slits extend from the first end to between the first end and the second end. The plurality of parallel slits define fingers of the wad.

An exemplary wad splaying tool includes at least one mandrel. Each mandrel has a free end, a shank, a transition extending from the free end to the shank, and a supported end (e.g., a bottom). The shank extends from the supported end to the transition. The free end has a diameter less than the diameter of the wad. The transition is a frusto-conical portion extending from the shank to the free end. The transition has a diameter at the shank (i.e., where the transition meets the shank) that is greater than the diameter of the wad.

The method entails positioning the wad in alignment with the free end of a mandrel of the wad splaying tool, with the first (open) end of the wad proximate to the free end of the mandrel and the opposite end of the wad distal to the free end of the mandrel. Then the wad is slid onto the mandrel until the free end of the first mandrel reaches the bottom covering of the wad (or until substantial resistance is encountered). The transition of the mandrel splays (bends outwardly) the fingers of the wad. Then the wad with the outwardly bent fingers is removed from the mandrel and loaded into a hull of a shotgun shell. Such loading may entail placing the wad into a wad holder of a reloading machine, and actuating the reloading machine to insert the wad from the wad holder into a hull. Prior to loading the wad into the hull, the hull will have been re-primed and loaded with powder. Thus, the wad is loaded into the shell, with the bottom covering of the wad being against the powder.

Depending upon the gauge of the shell, the distance from the free end of the first mandrel to the shank of the first mandrel may be from 0.5 to 2 inches, the diameter of the free end of the mandrel may be from about ⅜ inches to about ¾ inches, and the diameter of the transition at the shank may be from about ¾ inches to about 1.5 inches. Preferably, the free end of the mandrel is chamfered (provided with a symmetrical sloping edge) or filleted (provided with a convex rounded edge). The wad may be sized for any of various size shells, such as 12, 16, 20, or 28 gauge shells or 0.410 bore shells.

In one embodiment, the tool includes several (e.g., 2, 3 or more) mandrels. This allows a single tool that works with wads for various size shells. Some mandrels may accommodate more than one size wad. Thus an operator may keep the tool in position, regardless of the size shell being reloaded.

The mandrels may be attached to a base. In one embodiment, the base is a planar horizontal support (e.g., a plate). With the bottom of each mandrel mounted to the base, the mandrel extends vertically terminating at the free end. If several mandrels are provided, they are spaced apart by a sufficient distance (e.g., at least an inch), to provide working room. In one embodiment the mandrels are permanently attached to the base; while in another embodiment the mandrels are removable from the base. In a removable embodiment the mandrels may be mechanically fastened using threaded couplings, snap-fit couplings, a flanged bottom end with mechanical fasteners or any other suitable means of attachment including glue and welding.

Mandrels may be marked or color coded to identify the size of the wads that may be used with the mandrel. By way of example and not limitation, a mandrel may be marked or color coded for a wad for a 0.410 bore shell, or a wad for a 12 or 16 gauge shell, or a wad for a 20 gauge shell or a wad for a 28 gauge shell, or wads for 20 to 28 gauge shells.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A wad splaying tool according to principles of the invention spreads (i.e., flares) wad fingers prior to placement of the wad in a wad holder of a reloading machine. The flared fingers are spread apart, as conceptually illustrated in FIG. 10, discussed below. Such a wad is said to be splayed. The ram of a reloading machine will not catch or snag the fingers of the splayed wad during reloading.

Figure 1:
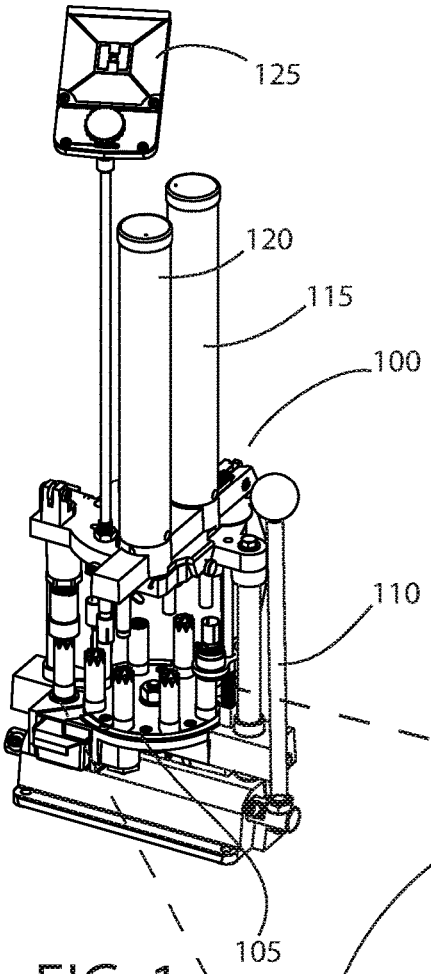
FIG. 1 conceptually illustrates a shell reloading machine into which wads prepared using a wad splaying tool according to principles of the invention are inserted.

FIG. 1 conceptually illustrates a shell reloading machine 100 into which wads splayed using a wad splaying tool according to principles of the invention are inserted. As shell reloading machines are available in various makes and models, the illustrated machine is intended to represent a generic shell loading machine and is not limited to any particular configuration. The machine 100 may be entirely manual or semi-automatic (e.g., hydraulic, pneumatic or electrically actuated). The invention may be adapted to any reloading machine or process that uses a ram to push into a shell a wad with fingers.

The machine 100 generally includes a turntable 105 with various stations. The turntable rotates incrementally through each successive station as the control handle 110 is pulled. One initial step in reloading using such a machine 100 is to supply an empty hull (i.e., an empty shell). The hull should be sized for a shell of a determined caliber or bore. The shell should be in good condition, clean and dry, without split ends, with intact metal bases, and exhibit no other visible damage. The machine 100 may resize and clean the hull.

After the hull is loaded and made ready for reloading, it advances to a primer station where a spent primer is replaced with a new primer. With a semiautomatic reloader, a pull of the handle lowers a punch that pushes out a spent primer from the metal base of the hull. After the spent primer has been removed, a new primer must be inserted in a primer pocket in the metal base. With most semi-automatic reloaders, a pull of the handle 125 forces the shell down over a new primer, which is thereby pressed into the primer pocket. Primers are fed from a primer tray 125 down a feed tube to a primer seat. The metal base of the hull is pressed firmly onto the primer in the primer seat.

After a new primer is set in the base of the hull, powder is deposited into the hull on top of the base, in communication with the primer. Many semiautomatic reloading machines fill a bushing with a known interior volume with powder, which is then deposited from the bushing into the hull. Powder is supplied via gravity from a container 120 through a valve or gate into the bushing with a bottom. To drop powder from the bushing into the hull, the bushing, without the bottom, is positioned over the hull, thereby allowing the powder to fall from the bushing into the hull.

After powder is deposited into the hull, a wad is inserted into the hull. Regardless of what system of reloading is used, the wad is handled manually. It is at this station that a tool according to principles of the invention is used. The structure and method of use of the tool will be discussed below, after the step of inserting a wad into a shell is described.

Figure 2:
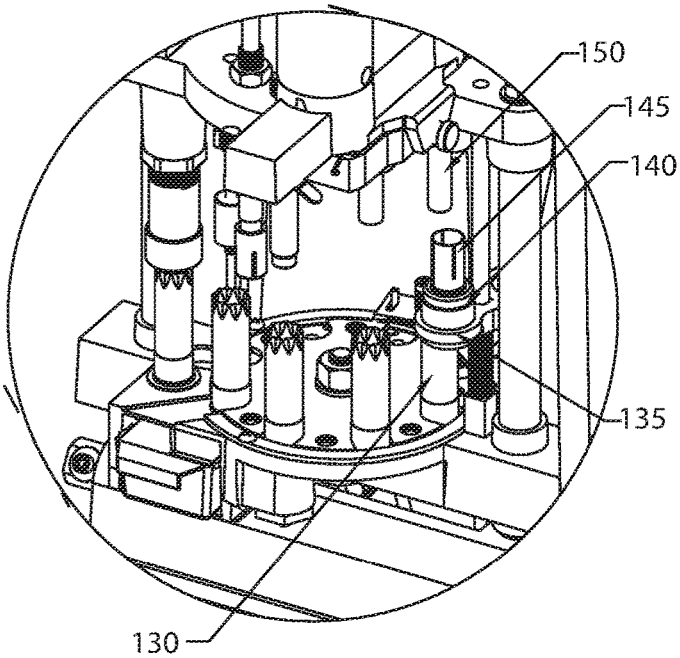
FIG. 2 conceptually illustrates a portion of a shell reloading machine into which wads prepared using a wad splaying tool according to principles of the invention are inserted.

A wad is removed from a storage container, e.g., a bag, that may contain hundreds of wads. With reference to FIG. 2, a removed wad 145 is placed in a wad guide 135 of the reloading machine 100. The operating handle 110 is pulled through a complete stroke. As the handle 110 is pulled, the machine aligns the wad guide 135 with the hull 130 and positions wad guide at and partially in the top opening of the hull 130. A wad ram 150 urges the wad 145 through the wad guide into the hull 130 firmly seated on top of the powder. Generally, the wad 145 should be sized and seated to allow upper edge of the wad 145 to sit below the crimp line of the hull 130.

Figure 7:
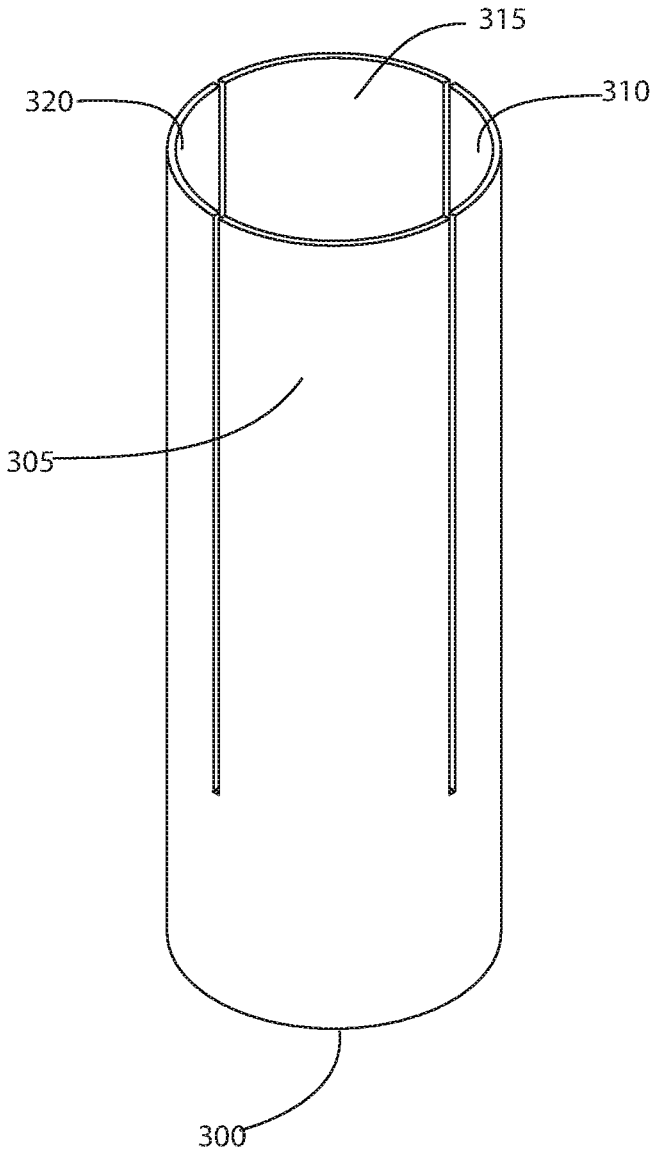
FIG. 7 provides a front perspective view of an exemplary undeformed wad for use with a wad splaying tool according to principles of the invention.

In FIG. 7 an exemplary wad 300 is shown. The wad 300 includes a plurality of fingers 305-320 defined by slits extending from the top edges of the cylindrical wad. The length of the wad occupies space between the top of the powder deposited in the hull and the crimp line at the top of the hull. The wad is typically comprised of a flexible plastic material.

Figure 8:
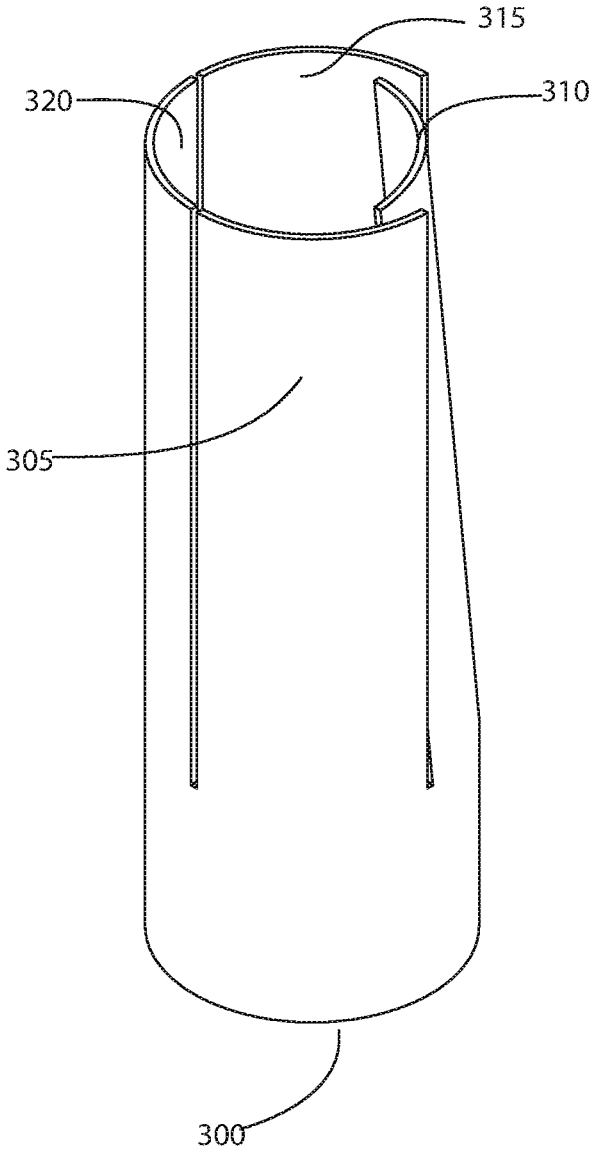
FIG. 8 provides a front perspective view of an exemplary deformed wad for use with a wad splaying tool according to principles of the invention.

After handling, storage, and temperature fluctuations, one or more fingers may be deformed. By way of example and not limitation, as shown in FIG. 8, one finger 310 is bent slightly inwardly.

If a wad 300 with one or more deformed (even if slightly deformed) fingers 310 is inserted in a wad guide for reloading, the ram 150 of the reloading machine 100 will likely crush and bend the deformed finger 310. Little clearance is provided between the sides of the ram and the fingers of a wad, especially in wads for small caliber (bore) shells, such as a 0.410 bore shell.

A wad finger crushed during reloading may not be noticeable because the wad is pressed into the hull below the crimp line. The crushed finger 310 will occupy space in the wad referred to as the shot cup. The crushed finger 310 in the shot cup prevents proper filling of the shot cup with shot. Space that would otherwise be occupied by deposited shot is now occupied or blocked by the crushed finger 310. As the ram crushes the finger 310, the force applied to the wad may be skewed. This may lead to improper seating of the wad against the powder. Consequently, when fired, the shell emits less than the desired volume of shot in an erratic shot pattern, with a compromised seal and aerodynamics, and therefore at substantially less velocity than desired.

If, prior to reloading, an operator notices the bent finger 310, the operator may attempt to bend the finger 310 outwardly using a finger of the operator's hand. However, such manual bending of the finger 310 using a finger of the operator's hand is often imprecise and transient. In a short period of time, the finger 310 may progressively return (relax) to its previously inwardly bent configuration. Even slight movement of the finger may be enough to precipitate snagging by the ram 150.

Additionally, if only one finger is bent outwardly, or all fingers are not bent outwardly equally, the wad may not sit correctly in the wad guide. This too increases risk of snagging.

If an operator, out of an abundance of caution, inserts a finger of the operator's hand into every wad before placement in the wad guide, the operator's finger will develop a sore, especially during a loading session that may involve about 100 shells per hour.

Figure 3:
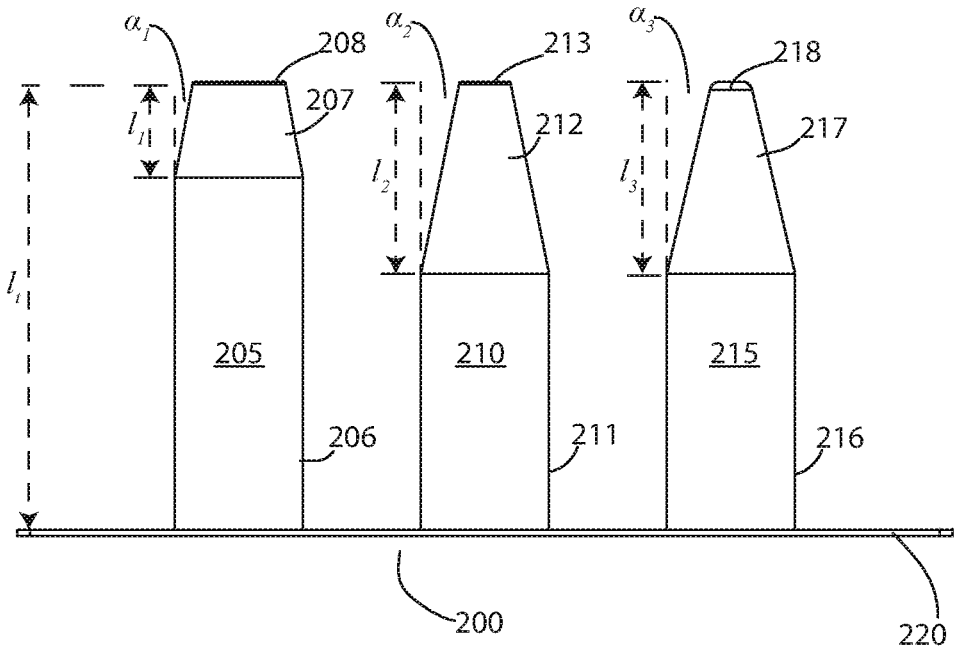
FIG. 3 provides a front view of an exemplary wad splaying tool according to principles of the invention.

The subject invention provides a tool and methodology for evenly splaying wad fingers before a wad is inserted into a wad guide of a reloader. With reference to FIG. 3, a front view of an exemplary wad splaying tool 200 according to principles of the invention is conceptually illustrated. The exemplary tool 200 includes a planar support base 220. A plurality, e.g., three, mandrels 205, 210, 215 extend upwardly from the top side of the base 220. Each mandrel includes a generally cylindrical shank 206, 211, 216 that leads to a chamfered (beveled) or fileted top, free end 208, 213, 218. The top has a diameter that is about equal to or slightly less than the inner diameter of the wad. Thus, each mandrel 205, 210, 215 may be sized to engage and splay wads for certain caliber (or bore) shells or a certain range of calibers (bores). The transition 207, 212, 217 from the shank 206, 211, 216, to the top 208, 213, 218 of each mandrel is generally frustoconical. The angles $\alpha_1$, $\alpha_2$, and $\alpha_3$ of the slanted sides of the transitions 207, 212, 217 relative to vertical, are acute, preferably less than 45°, more preferably less than 30°, more preferably about 5° to 20°, and more preferably about)(±5° the following: 10° for $\alpha_1$, 13° for $\alpha_2$, and 11° for $\alpha_3$. The total height, h, of each mandrel is preferably about 3 inches, with the length of each transition being between about 1 to 1.5 inches, and more preferably about 1 inch for $l_1$, and 1.5 inch for $l_2$, and 1.5 inch for $l_3$. The diameter of each shank 206, 211, 216 is preferably about 1". The diameter of each top 208, 213, 218 is preferably about (±⅛") the following: ⅝ inch for 208, 5/16 inch for 213, and 7/16 inch for 218. These top diameters accommodate wads for 12, 16, 20, and 28 gauge shells and 0.410 bore shells, with mandrel 205 accommodating wads for 12 and 16 gauge shells, mandrel 210 accommodating wads for 20 and 28 gauge shells, and mandrel 215 accommodating wads for 0.410 bore shells. These top diameters are less than the inner diameter of the respective shells and less than the inner diameter of the wads for the respective shells.

Figure 4:
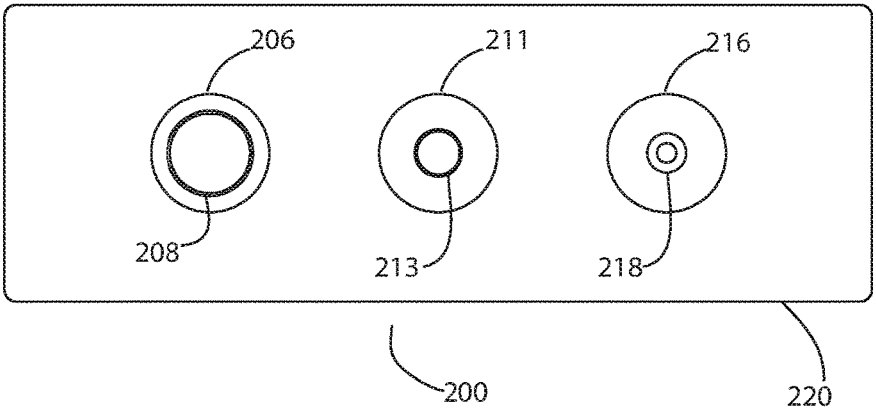
FIG. 4 provides a plan view of an exemplary wad splaying tool according to principles of the invention.
Figure 5:
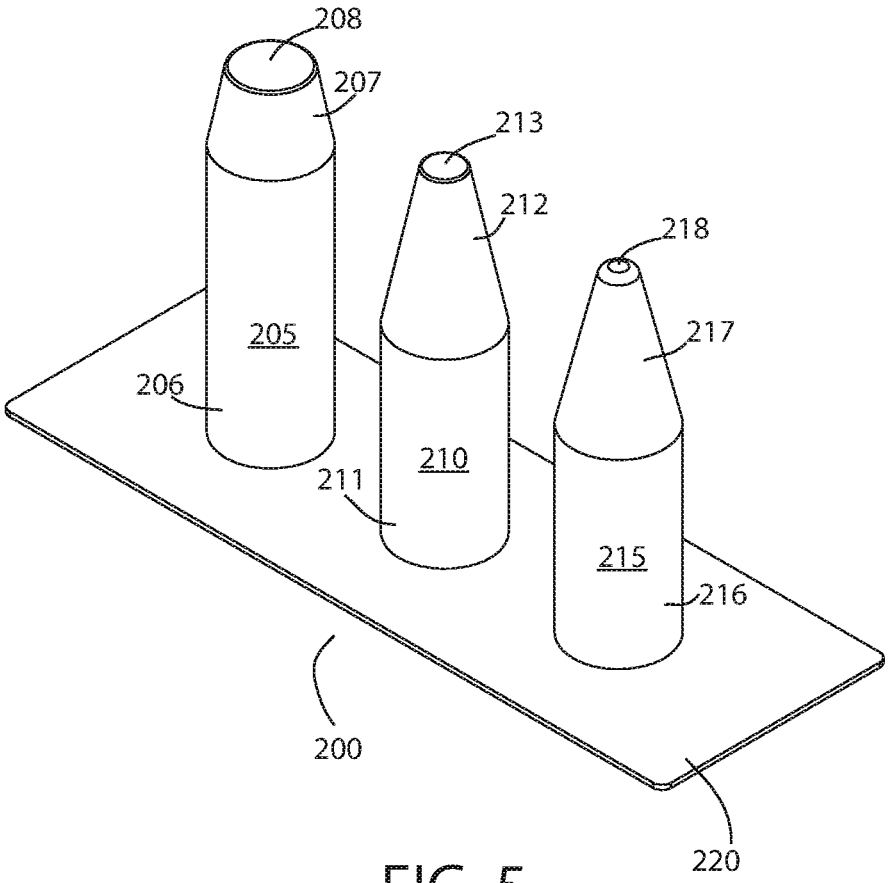
FIG. 5 provides a front perspective view of an exemplary wad splaying tool according to principles of the invention.

FIGS. 4 and 5 provides plan and perspective views of the exemplary wad splaying tool 200 according to principles of the invention. The shape and size of the base 220 may vary without departing from the scope of the invention. Likewise, the number of mandrels and their positions may also vary. Illustratively, each mandrel may be provided separately.

Figure 6:
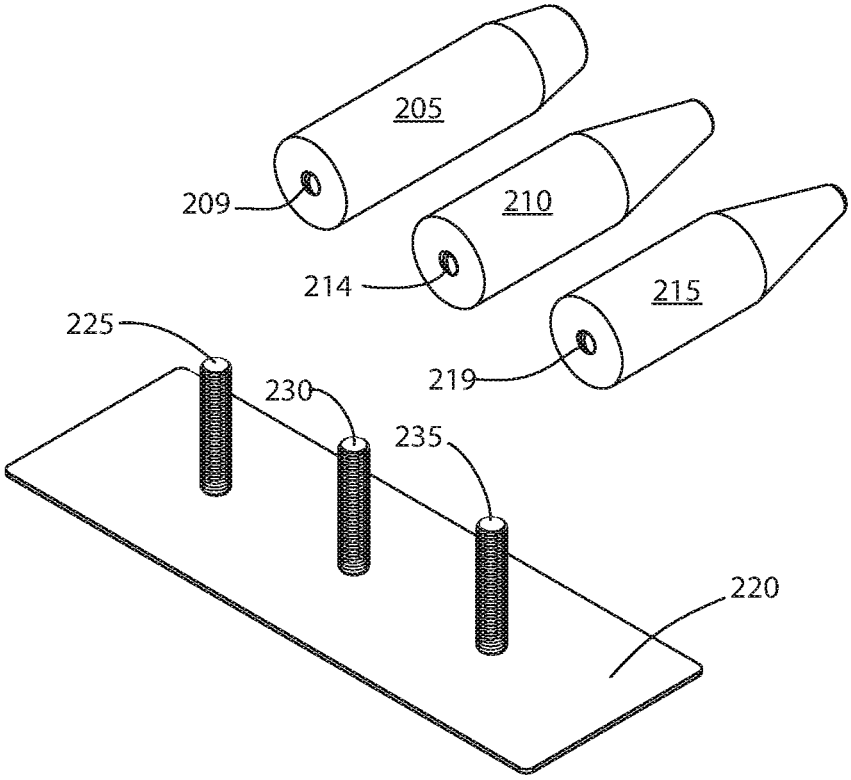
FIG. 6 provides a front perspective view of an exemplary wad splaying tool with removed removable mandrels according to principles of the invention.

Mandrels 205, 210, 215 may be permanently or removably attached to the base 220. FIG. 6 provides a front perspective view of an exemplary wad splaying tool 200 with removed removable mandrels 205, 210, 215 according to principles of the invention. In this embodiment, threaded shafts 225, 230, 235 extend upwardly from the base 220. The bottom of each mandrel 205, 210, 215 includes a threaded channel 209, 214, 219. The threaded channel 209, 214, 219 receives and threadedly engages the threaded shafts 225, 230, 235. Thus, removable mandrels may be removed, replaced and rearranged. Other attachments, such as screws, snap fit couplings, and press fit couplings may be used to secure the mandrels 205, 210, 215 to the base 220.

Mandrels are noticeably different in top end diameters. Even a new user will recognize which mandrel fits which wad. However, to avoid any possibility of confusion, mandrels 205, 210, 215 may be color coded and/or marked with indicia to clearly indicate the size or range of sizes of wads that can be splayed with the mandrel, without damaging the wads.

Figure 9:
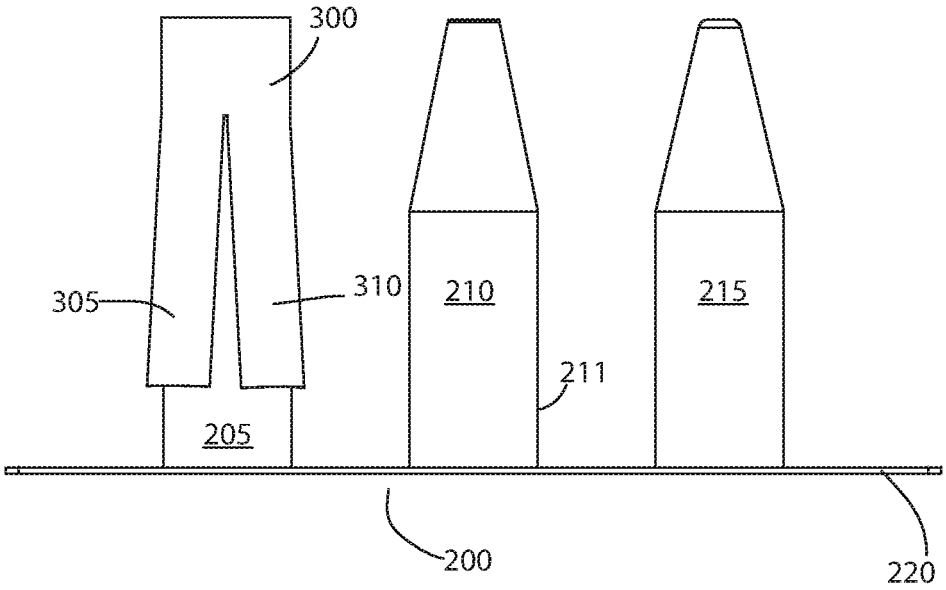
FIG. 9 provides a front view of an exemplary wad for on a wad splaying tool according to principles of the invention.

Referring now to FIG. 9, a front view of an exemplary wad 300 on the wad splaying tool 200 according to principles of the invention is provided. Prior to splaying, the wad may have been undeformed as in FIG. 7 or deformed as in FIG. 8. In either case, the fingers 305-320 of the wad are spread outwardly (i.e., splayed). The fingers 305-320 are urged outwardly by the transition section as the wad is slid down onto the mandrel, receiving the top end and transition section of the mandrel in the shot cup of the wad 300.

Figure 10:
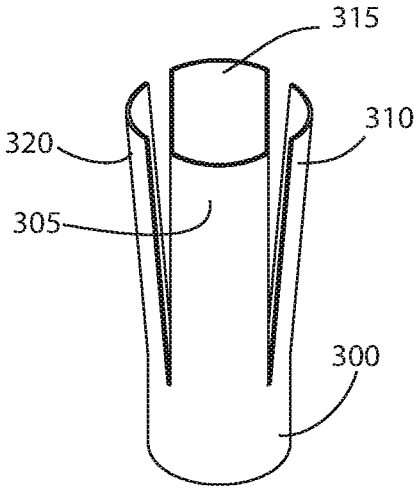
FIG. 10 provides a front perspective view of an exemplary splayed wad produced using a wad splaying tool according to principles of the invention.

FIG. 10 provides a front perspective view of the exemplary splayed wad 300 produced using the wad splaying tool as in FIG. 9. The fingers 305-320 are noticeably splayed, bent outwardly. When the wad 300 is placed in a wad holder 140 for insertion into a hull 145 during reloading, the ram 150 will not snag the fingers. As the wad 300 fingers are evenly splayed, the wad will sit upright (not skewed) in the wad holder 140 and seat properly in the hull 145.

A tool according to principles of the invention may be comprised of any material that exhibits sufficient rigidity and strength to repeatedly receive a wad and splay the fingers of a wad. By way of example and not limitation, the rim cover may be fabricated using wood, metal, or plastic by any suitable forming technique. For example, the tool may be comprised of a plastic or polymeric material, such as natural or synthetic rubber, polyvinyl chloride (PVC), nylon, polysulfone, polyethylene, polypropylene, polystyrene, acrylics, cellulosics, acrylonitrile-butadiene-styrene (ABS) terpolymers, urethanes, thermo-plastic resins, thermo-plastic elastomers (TPE), acetal resins, polyamides, polycarbonates and/or polyesters. Preferably the chosen material is relatively inexpensive, produces a durable and strong product, is easy to use in manufacturing operations and results in an aesthetically acceptable product.

The material may optionally further include coatings or additives to provide desired properties such as desired colors, structural characteristics, glow-in-the dark properties and thermal reactivity (e.g., color changes according to heat). Illustratively, phosphorescent polymer additives, such as aluminate based phosphors, may be added to adsorb light energy and continue to release that energy as visible light, after the energy source is removed. Advantageously, such an embodiment provides a glow-in-the-dark tool that is easy to locate in a dark space.

The tool 200 may be produced using any suitable manufacturing techniques known in the art for the chosen material, such as (for example) casting, forging, milling, extruding, machining, injection molding, compression molding, structural foam molding, blow molding, or transfer molding; polyurethane foam processing techniques; and vacuum forming. Preferably the manufacturing technique is suitable for mass production at relatively low cost per unit, and results in an aesthetically acceptable product with a consistent acceptable quality and structural characteristics.

In one preferred embodiment the mandrels and base are comprised of aluminum, steel or stainless steel, with the mandrels being welded to the base. In another preferred embodiment the mandrels are removable from the base. In yet another preferred embodiment, the mandrels are comprised of hard wood. In yet another preferred embodiment the mandrels and/or base are comprised of plastics.

Figure 11:
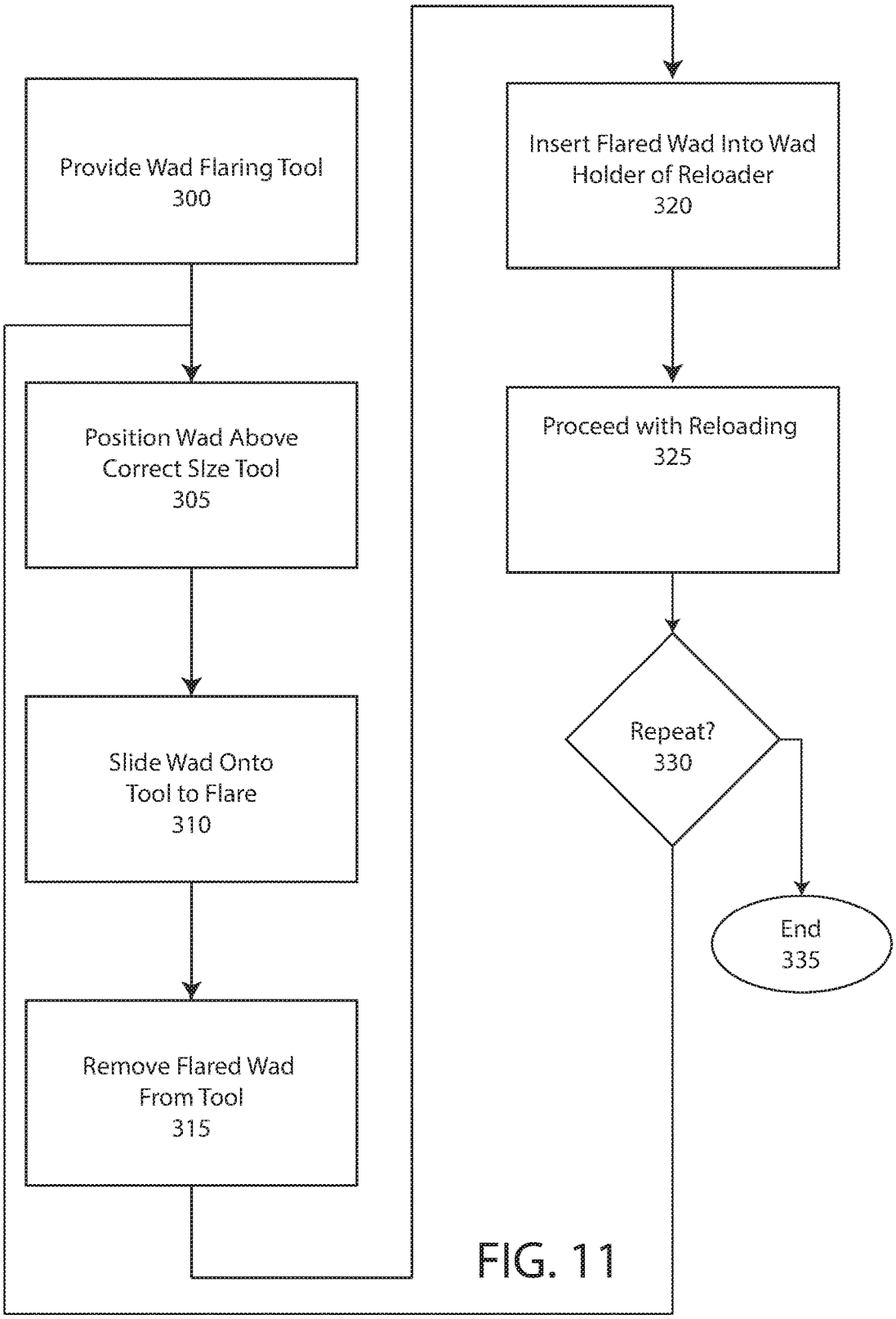
FIG. 11 provides a flowchart conceptually illustrating steps of an exemplary wad splaying methodology using a wad splaying tool according to principles of the invention.

FIG. 11 provides a flowchart that conceptually illustrates steps of an exemplary wad splaying and reloading methodology using a wad splaying tool according to principles of the invention. In step 300, a tool according to principles of the invention, as described above, is provided. The tool includes a mandrel that is sized and shaped for the particular gauge wad to be loaded into a hull. Next, in step 305, the wad is removed from a storage container such as a bag and positioned over the mandrel with the fingers of the wad and the opening of the shot cup facing downwardly in alignment with the mandrel. Next, in step 310, the wad is slid downwardly onto the mandrel until the top of the mandrel reaches the solid base of the wad. This action evenly flares (splays) the fingers of the wad, due to the shape of the mandrel. The splayed wad is then removed from the mandrel in step 315 by lifting the wad off the mandrel. Then the splayed wad is inserted into the wad holder of the reloader, in step 320. Then the steps of reloading are resumed, as in step 325. This methodology may be repeated for an entire session for every wad inserted into a wad holder for reloading, as in steps 330, 335. The time it takes to complete these steps is less than 10 seconds per wad, in many cases less than 5 seconds per wad, especially if the wads, tool and reloading machine are strategically positioned with the tool in proximity to the wad holder and the supply of wads in proximity to the tool.

Referring again to FIG. 1, after a wad has been inserted into a hull, shot is deposited into the shot cup of the wad in the hull. Most semi-automatic reloaders use a built-in volumetric measure, e.g., a bushing or "charge bar" that contains a cavity for a determined volume of shot. Shot is dropped from a container 115 into the cavity, then into the shot cup of the wad. Using a wad that has been splayed using a wad tool according to principles of the invention helps to ensure that the shot cup provides the proper storage compartment for receiving the desired volume of shot, and further helps to ensure integrity and performance of the shell.

After all the shot has been deposited, the shell is crimped for closure. Almost all modern reloaders seal the shell with a "star" folded crimp. The crimp usually takes a few steps including a starting crimp that partially closes the hull, following original folds of the shell, followed by one or more additional crimping and shaping steps to achieve a desired closure configuration.

In sum, a method of splaying fingers of a wad prior to loading the wad into a shell (shotgun shell) and a tool for splaying fingers of a wad prior to loading the wad into a shell are provided. A wad is a generally cylindrical plastic sleeve having a diameter, a first end, a second end, and a bottom covering at the second end. The first end is open. A plurality of parallel slits extend from the first end to between the first end and the second end. The plurality of parallel slits define fingers of the wad.

An exemplary wad splaying tool includes at least one mandrel. Each mandrel has a free end, a shank, a transition extending from the free end to the shank, and a supported end (e.g., a bottom). The shank extends from the supported end to the transition. The free end has a diameter less than the diameter of the wad. The transition is a frusto-conical portion extending from the shank to the free end. The transition has a diameter at the shank (i.e., where the transition meets the shank) that is greater than the diameter of the wad.

The method entails positioning the wad in alignment with the free end of a mandrel of the wad splaying tool, with the first (open) end of the wad proximate to the free end of the mandrel and the opposite end of the wad distal to the free end of the mandrel. Then the wad is slid onto the mandrel until the free end of the first mandrel reaches the bottom covering of the wad (or until substantial resistance is encountered). The transition of the mandrel splays (bends outwardly) the fingers of the wad. Then the wad with the outwardly bent fingers is removed from the mandrel and loaded into a hull of a shotgun shell. Such loading may entail placing the wad into a wad holder of a reloading machine, and actuating the reloading machine to insert the wad from the wad holder into a hull. Prior to loading the wad into the hull, the hull will have been re-primed and loaded with powder. Thus, the wad is loaded into the shell, with the bottom covering of the wad being against the powder.

Depending upon the gauge of the shell, the distance from the free end of the first mandrel to the shank of the first mandrel may be from 0.5 to 2 inches, the diameter of the free end of the mandrel may be from about ⅜ inches to about ¾ inches, and the diameter of the transition at the shank may be from about ¾ inches to about 1.5 inches. Preferably, the free end of the mandrel is chamfered (provided with a symmetrical sloping edge) or filleted (provided with a convex rounded edge). The wad may be sized for any of various size shells, such as 12, 16, 20, or 28 gauge shells or 0.410 bore shells.

In one embodiment, the tool includes several (e.g., 2, 3 or more) mandrels. This allows a single tool that works with wads for various size shells. Some mandrels may accommodate more than one size wad. Thus an operator may keep the tool in position, regardless of the size shell being reloaded.

The mandrels may be attached to a base. In one embodiment, the base is a planar horizontal support (e.g., a plate). With the bottom of each mandrel mounted to the base, the mandrel extends vertically terminating at the free end. If several mandrels are provided, they are spaced apart by a sufficient distance (e.g., at least an inch), to provide working room. In one embodiment the mandrels are permanently attached to the base; while in another embodiment the mandrels are removable from the base. In a removable embodiment the mandrels may be mechanically fastened using threaded couplings, snap-fit couplings, a flanged bottom end with mechanical fasteners or any other suitable means of attachment including glue and welding.

Mandrels may be marked or color coded to identify the size of the wads that may be used with the mandrel. By way of example and not limitation, a mandrel may be marked or color coded for a wad for a 0.410 bore shell, or a wad for a 12 gauge shell, or a wad for a 20 gauge shell or a wad for a 28 gauge shell, or wads for 20 to 28 gauge shells.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of splaying fingers of a wad prior to loading the wad into a shell, said method comprising steps of:

providing a wad, the wad comprising a generally cylindrical plastic sleeve having a first diameter, a first end, a second end, a bottom covering at the second end and the first end being open, and a plurality of parallel slits extending from the first end to between the first end and the second end, the plurality of parallel slits defining fingers of the wad;

providing a wad splaying tool, the wad splaying tool comprising at least one mandrel, including a first mandrel, the at least one mandrel having a free end, a shank, a transition extending from the free end to the shank, a supported end, the shank extending from the supported end to the transition, the free end having a second diameter less than the first diameter of the wad, the transition comprising a frusto-conical segment extending from the shank to the free end, the transition having a third diameter at the shank, the third diameter being greater than the first diameter of the wad;

positioning the wad in alignment with the free end of the first mandrel of the wad splaying tool with the first end of the wad proximate to the free end of the first mandrel and the second end of the wad distal to the free end of the first mandrel;

sliding the wad onto the first mandrel until the free end of the first mandrel reaches the bottom covering of the wad, the transition of the first mandrel causing the fingers of the wad to bend outwardly;

removing the wad with the outwardly bent fingers from the first mandrel; and loading the wad into a hull, the hull being a hull of a shotgun shell.

2. The method of splaying fingers of a wad prior to loading the wad into a shell according to claim 1, the distance from the free end of the first mandrel to the shank of the first mandrel being from 0.5 to 2 inches.

3. The method of splaying fingers of a wad prior to loading the wad into a shell according to claim 1, the second diameter being from about ⅜ inches to about ¾ inches.

4. The method of splaying fingers of a wad prior to loading the wad into a shell according to claim 1, the third diameter being from about ¾ inches to about 1.5 inches.

5. The method of splaying fingers of a wad prior to loading the wad into a shell according to claim 1, the free end being chamfered.

6. The method of splaying fingers of a wad prior to loading the wad into a shell according to claim 1, the free end being filleted.

7. The method of splaying fingers of a wad prior to loading the wad into a shell according to claim 1, the wad being sized for one of a 12 gauge shell and a 16a 12 gauge shell.

8. The method of splaying fingers of a wad prior to loading the wad into a shell according to claim 1, the wad being sized for a 20 gauge shell.

9. The method of splaying fingers of a wad prior to loading the wad into a shell according to claim 1, the wad being sized for a 28 gauge shell.

10. The method of splaying fingers of a wad prior to loading the wad into a shell according to claim 1, the wad being sized for a 0.410 bore shell.

11. The method of splaying fingers of a wad prior to loading the wad into a shell according to claim 1, the wad splaying tool further comprising a second mandrel.

12. The method of splaying fingers of a wad prior to loading the wad into a shell according to claim 1, the wad splaying tool further comprising a third mandrel.

13. The method of splaying fingers of a wad prior to loading the wad into a shell according to claim 1, the at least one mandrel being mounted at the supported end to a planar support base.

14. The method of splaying fingers of a wad prior to loading the wad into a shell according to claim 1, the at least one mandrel being removably mounted at the supported end to a planar support base.

15. The method of splaying fingers of a wad prior to loading the wad into a shell according to claim 1, the step of loading the wad into a hull further comprising steps of placing the wad into a wad holder of a reloading machine, and actuating the reloading machine to insert the wad from the wad holder into the hull.

* * * * *